United States Patent [19]

Büttner

[11] 4,409,061

[45] Oct. 11, 1983

[54] MACHINE FOR TYING PACKAGES

[76] Inventor: Hans H. Büttner, Obmettmann 13, 4020 Mettmann, Fed. Rep. of Germany

[21] Appl. No.: 349,543

[22] Filed: Feb. 17, 1982

[30] Foreign Application Priority Data

Mar. 19, 1981 [DE] Fed. Rep. of Germany ..... 3110718

[51] Int. Cl.[3] ..... B32B 31/00

[52] U.S. Cl. ..... 156/502; 100/27; 100/33 PB

[58] Field of Search ..... 100/33 PB, 27, 28; 156/502, 468

[56] References Cited

U.S. PATENT DOCUMENTS

| | | | |
|---|---|---|---|
| 3,665,845 | 5/1972 | Lyon | 100/33 PB X |
| 3,701,314 | 10/1972 | Tull | 100/28 |
| 3,771,435 | 11/1973 | Vascotto et al. | 100/33 PB X |

*Primary Examiner*—David A. Simmons

*Attorney, Agent, or Firm*—Martin A. Farber

[57] ABSTRACT

A machine for the tying of packages, having a gripper which places the tying means around the package, the gripper being moved by a pull means and stopped in a position where the ends of the tying means are connected to each other. A consistent return of the gripper to the basic position is due to the fact that the basic position of the gripper lies approximately at the center point of an arcuate section of the path of the gripper pull means so that the gripper position is retained even though the pull means may continue to move.

17 Claims, 11 Drawing Figures

4
40
40'
32
43
31
33
34''
35
36
42
24
34
34'
37
28
30
29
12
50
5

MACHINE FOR TYING PACKAGES

The present invention relates to machines for tying packages and more particularly to a tying machine which does not require a brake to position a gripper for the tying material at a predetermined basic stop position. Machines for tying packages generally include a gripping device which holds the tying material as the material is placed around the package over a predetermined path. The gripping device is moved by a pull means, such as a chain, also moving along a predetermined path, and is stopped in a basic stop position near a closing device which connects the ends of the tying material and holds the free end of the tying material for another tying cycle.

The problems with such machines relate to stopping the gripping device precisely in a predetermined stop position after it has moved the tying material over the predetermined winding path. Despite the use of costly brake means it frequently happens that the desired predetermined stop position is not the actual stopping point of the gripping device. This results in difficulties in connecting the ends of the tying means together by the closing device.

The object of the present invention is to provide a machine for tying packages which is easy to manufacture, does not require expensive brake means and includes a gripping device that returns to a basic predetermined stop position after the gripping device has moved over the predetermined winding path.

This object is achieved by locating the basic predetermined stop position of the gripping device at approximately the center point of an arcuate section of the path of the pull means which pull the tying means.

The gripping device which is moved by the pull means always returns to the basic predetermined stop position, located approximately at the center point of an arcuate section of the path of the pull means after the gripping device has moved over its predetermined path. The gripping device does not leave this basic predetermined stop position as long as the point of attachment of the gripping device to the pull means is disposed in the arcuate section. The longitudinal motion of the point of attachment of the gripping device is thus converted into a swinging motion when the point of attachment is disposed in the arcuate section. Accordingly it is possible to dispense with expensive brake installations yet still to produce an accurate stopping of the pull means at a desired predetermined stop position. Since the gripping device always returns to its precise basic predetermined stop position, the connecting process effected by the closing device can be accurately carried out.

One further advantageous development resides in the fact that the basic predetermined stop position of the gripping device is near the corner of the path of the typing means. In addition the gripping device is supported on a carrier arm which is guided by means of a guide roller on a rail path lying between the gripping device and the point of attachment to the pull means, the rail path being provided with control-curve sections over the arcuate region of the path of the pull means, one of the control curve sections governing movement of the gripping device from the basic position around the holding clamp of the closing device. Two control-curve sections which are adjacent to each other are preferably used. The first control-curve section is concentric with respect to the arcuate section of the path of the pull means. Therefore when the guide member in the rail path moves along the first control-curve section, the point of attachment of the pull means is disposed within the arcuate section of the pull means path so that a swinging movement of the gripper takes place as long as the guide roller in the rail path is within the first section of the control curve. It is only when the guide roller leaves the first control-curve section and moves into the adjacent control-curve section that the gripper changes its position, whereupon it is moved around the holding clamp of the closing device. The construction of the closing device is thus simplified since the movement of the gripping device around the holding clamp is attributable to the configuration of the rail path and the path of the pull means. It has been found structurally advantageous to have the pull means guided in a reorientation-arc slot within the region of the arcuate section. A closed frame can be used here for guiding the pull means. If the pull means is a chain, sprocket wheels can be arranged at three corners of the frame while the reorientation-arc slot is arranged in the region of the fourth corner.

A further advantageous feature is that the linear section of the path of the pull means which is located in front of the arcuate section extents at an acute angle to the rail path of the gripper carrier arm.

With the above and other objects and advantages in view, the present invention will become more clearly understood in connection with the detailed description of a preferred embodiment, when considered with the accompanying drawings, of which:

Figure 1:
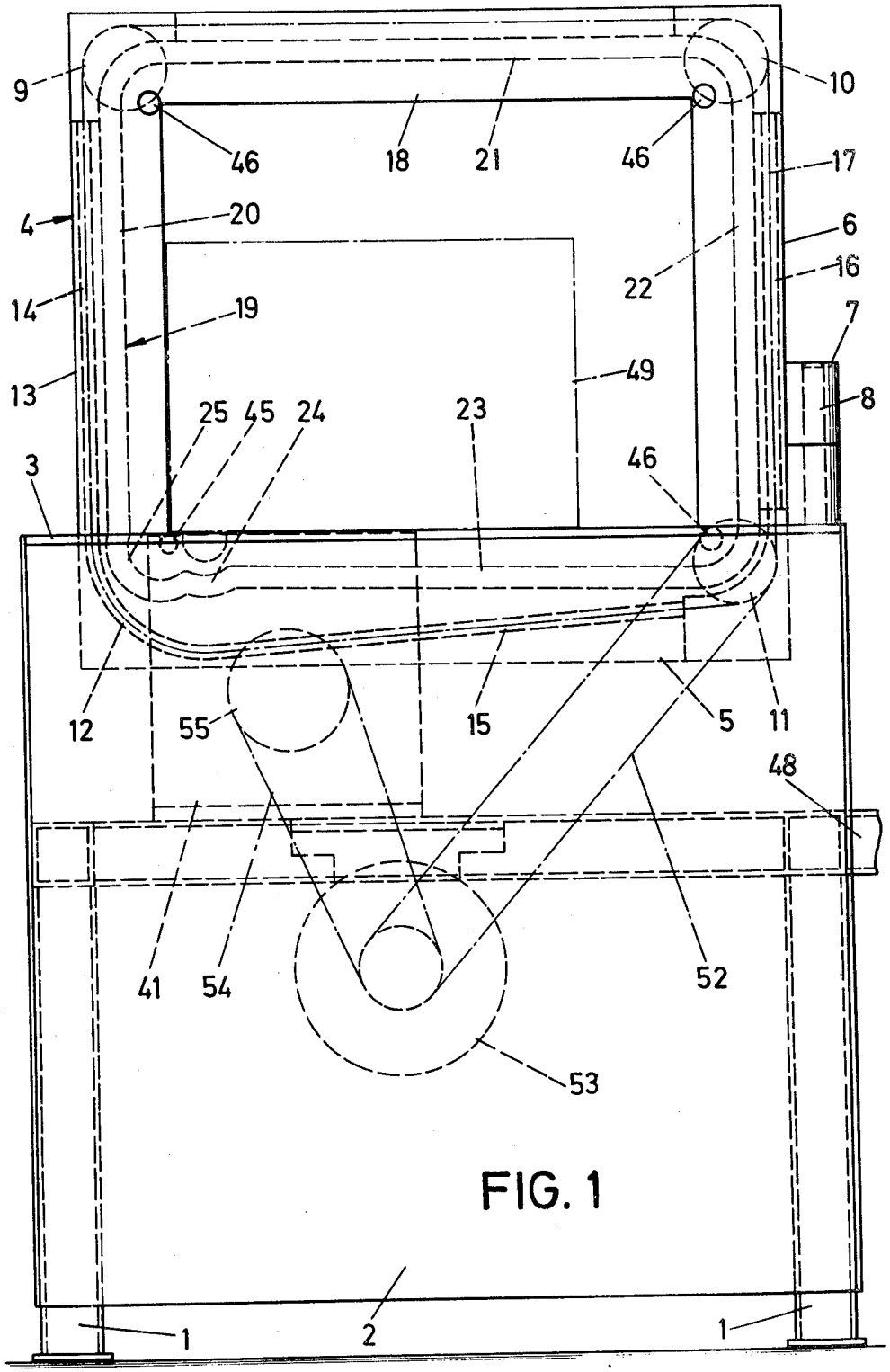
FIG. 1 is a simplified view of the tying machine, in elevation; incorporating one embodiment of the invention

Referring now to the drawings, especially FIG. 1, the tying machine has a base 2 which rests on feet 1. The base bears a tabletop 3 on its top side.

A rectangular frame 4 whose lower horizontal sidepiece 5 is located within the machine base 2 extends above the tabletop 3. A bearing lug 7 through which a pin 8 extends into a bed of the base 2 is fastened to the right vertical sidepiece 6 of the frame 4.

Sprocket wheels 9, 10 and 11 are mounted on three corners of the frame 4. A milled arcuate section 12 is formed in the lower left corner of the frame 4. The arc section 12 is continued, in the left vertical sidepiece 13, by a linearly extending groove section 14 terminating just in front of the upper sprocket wheel 9 and in the lower horizontal sidepiece 5 by a linear, slightly ascending groove section 15 which terminates in front of the lower sprocket wheel 11. A groove-shaped section 16 is also milled in the right vertical sidepiece 6. The pull means 17, for instance a chain, is placed around the sprocket wheels 9, 10, 11 in such a manner that the pull means extends freely in the region of the upper horizontal sidepiece 18 while in the other individual regions of the frame 4 the chain 17 extends within the sections 12, 14, 15 and 16.

Figure 2:
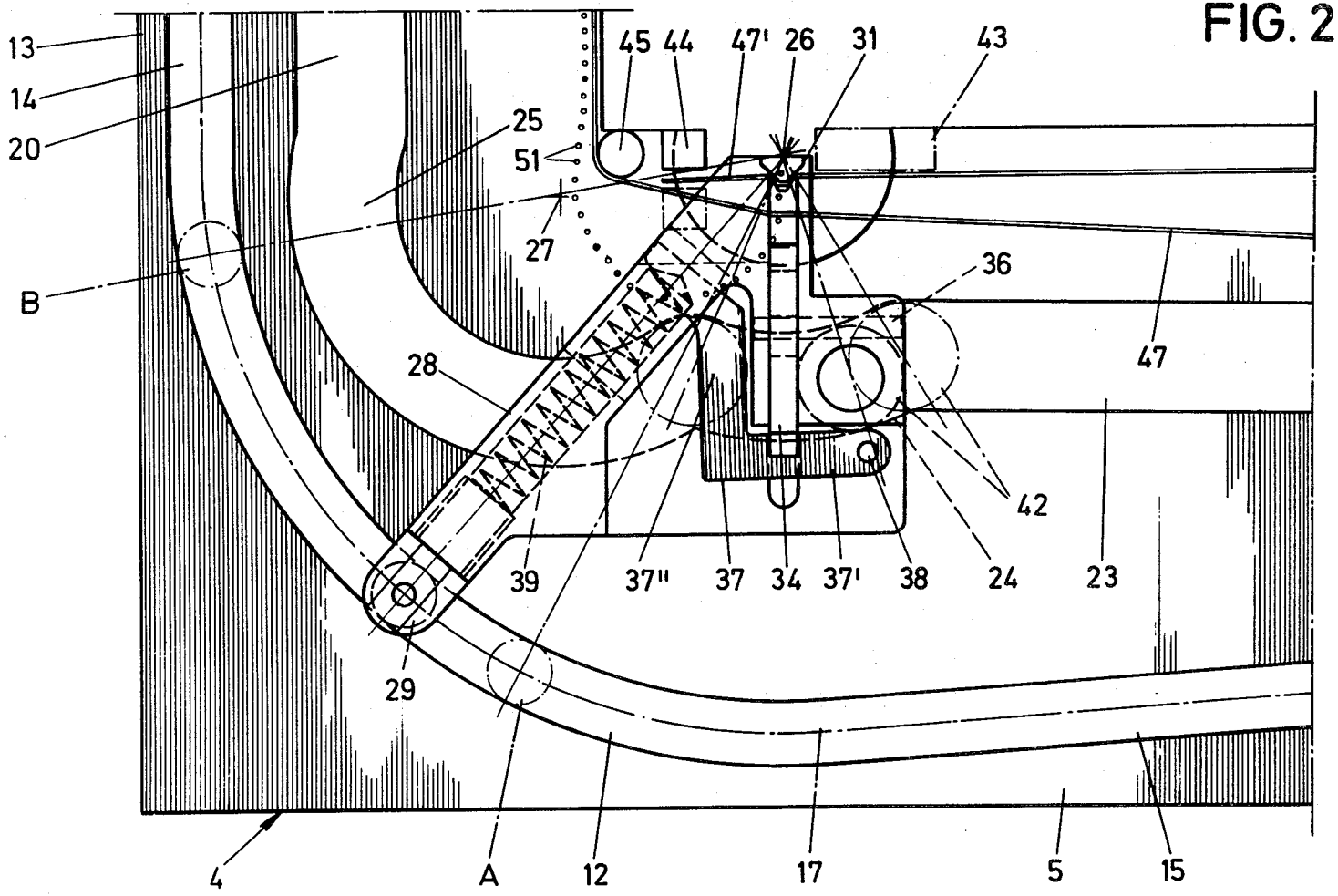
FIG. 2 is an enlarged fragmentary view of a gripping device in its basic predetermined stop position, the gripping device being located close to the corner of the path of a tying means.

Furthermore, the frame 4 is provided with a rail path 19 which lies inward of the path of the pull means 17. Referring to FIG. 1 the rail path 19 is defined by a section 20 formed in the vertical sidepiece 13, a section 21 formed in the upper horizontal sidepiece 18, a section 22 formed in the right-hand vertical sidepiece 6, a section 23 formed in the lower horizontal sidepiece 5 and two control-curve sections 24 and 25 milled in the left-hand corner of the horizontal sidepiece 5. The section 23 ascends slightly in the direction from right to left as seen in FIG. 1. As most clearly shown in FIG. 2 the center point of the arc section 12 is designated 26. The point 26 is also the center point of the control-curve section 24 (FIG. 2). The center point 27 (FIG. 2) of the other control-curve section 25 lies below the center point 26 and to its left.

As can be clearly noted from FIG. 1, the linear portion 15 of the path of the pull means 17, which is arranged in front of the arc section 12, is inclined at an acute angle to the portion 23 of the rail path 19.

Figure 3:
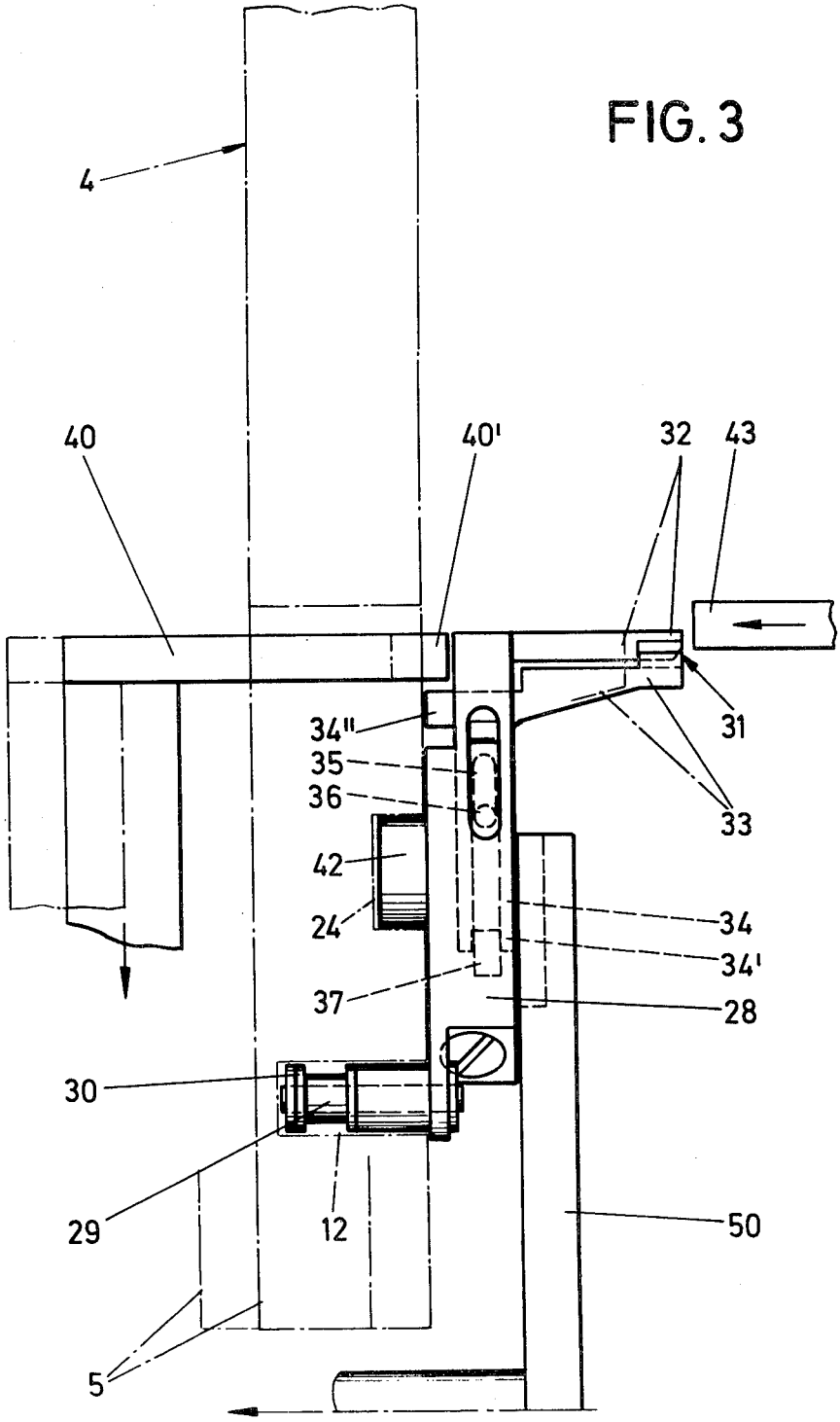
FIG. 3 is a side view of FIG. 2.

The pull means path 12, 14, 15 and 16 and the rail path 19 serve to guide of a gripper carrier arm 28 (FIGS. 2 and 3). The gripper carrier arm 28 is provided on its outer end with a pull-means point of attachment 29 to an individual link 30 (FIG. 3) of the chain which forms the pull means 17.

At its other end the carrier arm 28 contains a gripper 31. The gripper 31 consists of an upper gripper jaw 32 which is fixed to the carrier arm 28 and a lower gripper jaw 33 which can be displaced in a direction towards the gripper jaw 32. The lower gripper jaw 33 is seated on a slide 34 which is guided lengthwise in the carrier arm 28. A slot 35 therein is traversed by a transverse pin 36 of the carrier arm 28. One arm 37' of a bell-crank lever 37 pivoted to the carrier arm 28 engages the lower forked end 34' of the slide 34. A pivot pin designated 38 and passes through the free end of the arm 37' of the bell-crank lever 37. The other arm 37'' is engaged by a compression spring 39 arranged within the carrier arm 28.

The lower gripper jaw 33 is controlled by a finger 40 which, as is shown in FIG. 3, can carry out both a horizontal movement and a vertical movement. The free end 40' of the finger 40 cooperates with a projection 34'' on the slide 34. The movement of the finger 40 is controlled by a closure device 41 schematically indicated in FIG. 1.

Referring to FIGS. 2 and 3, a roller 42 is mounted on the carrier arm 28 on the section between gripper 31 and the point of attachment 29 of the pull means, the roller 42 engaging in form-fitting manner in the control curve section 24 of the rail path 19.

In its basic predetermined stop position the gripper 31 lies at the level of the center point 26 close to the left-hand lower corner of the frame 4. An upper pressure jaw 43 extends along the gripper 31 on its right-hand side, the jaw 43 being offset from the plane of the tying means 47 as shown in FIGS. 2 and 3. Referring now to FIG. 2, a holding clamp 44 which extends into the plane of the tying means 47 but is open, is seated to the left of the gripper 31. A support pin 45 which has been previously brought into the plane of the tying means 47 is adjacent the left side of the holding clamp 44. Movement of the support pin 45 is controlled as a function of movement of the upper pressure jaw 43 of the closing device 41 such that the pressure jaw 43 and the support pin 45 are displaced relative to each other. As seen in FIG. 1 the support pin 45 is located at the left-hand inner lower corner of the frame 4. Support pins 46 which can be shifted into and out of the plane of the tying means are provided on the other inner corners of the frame 4.

Figure 4:
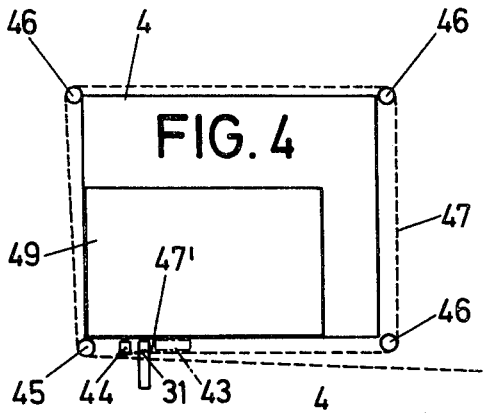
FIGS. 4 to 11 show different positions during the tying cycle.

The manner of operation is as follows. The machine is in its starting position, as shown in FIGS. 2, 3 and 4. Accordingly the gripper 31 is in its basic position. An end 47' of the tying means 47 is clamped by the gripper jaws 32 and 33 and extends around the support pins 46 and 45 which have been previously moved into the plane of the tying means. The tying means 47 is deflected by the supporting pin 45 towards a roll of tying means (not shown) with which there is associated a known tying-means tensioning device, also not shown. Both the roll of tying-means and the tensioning device are fastened to a projecting arm 48 (FIG. 1) on the machine frame 2.

In the basic position of the gripper 31, its roller 42 is disposed in the control-curve section 24 while the point of attachment 29 of the pulling means lies within the arcuate section 12 of the path of the pulling means 17. As long as the point of attachment 29 of the pulling means moves between the points A and B, (FIG. 2) the roller 42 will lie in the control-curve section 24, as shown in dot dash line. Therefore the gripper 31 merely pivots at the center point 26 and does not change its linear position.

Figure 5:
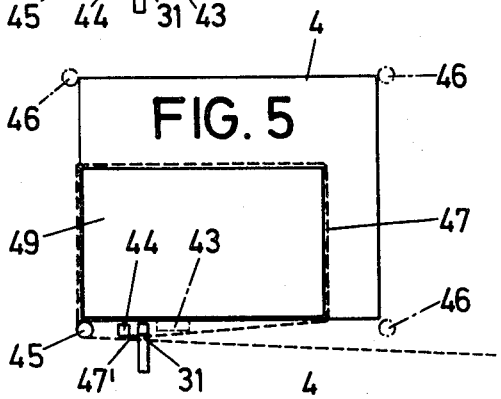

If a package 49 is now placed on the tabletop 3 and a switch pulse is produced, the support pins 46 move out of the plane of the tying means, whereupon the tying means 47 can encompass the package 49, as shown in FIG. 5. The tensioning device (not shown) ensures that the tying means 47 tightly wraps the package 49.

Figure 6:
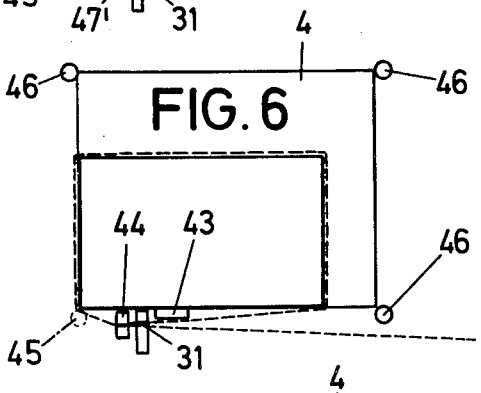

FIG. 6 shows that the upper pressure jaw 43 is now moved into the plane of the tying means 47. The support pin 45 moves back while the other support pins 46 again enter into the plane of the tying means. At the same time the holding clamp 44 closes.

Figure 7:
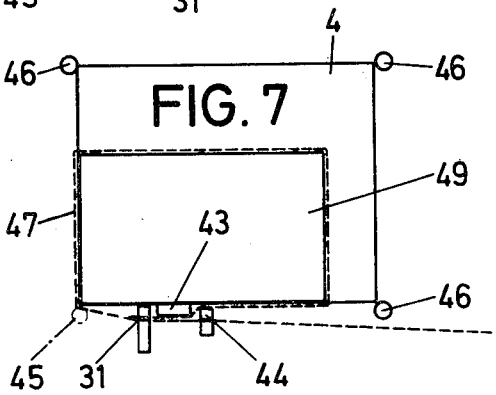
Figure 11:
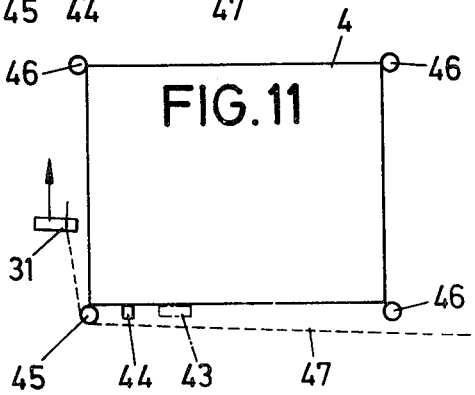

FIG. 7 indicates that the holding clamp 44 has moved to the other side of the pressure jaw 43, producing a tensioning of the tying means 47. The connecting of the end 47' to the tying means 47 by melting is then effected in a known manner.

Figure 8:
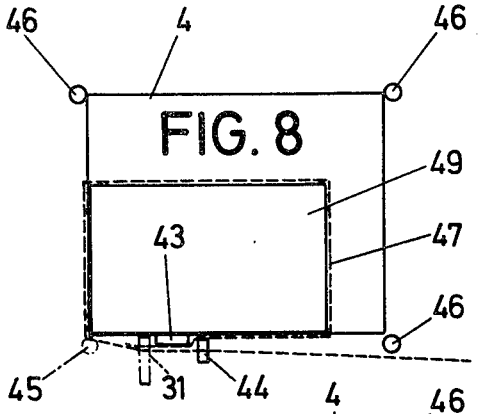

The position indicated in FIG. 8 shows that the welding process has been completed; the gripper 31 then moves out of the plane of the tying means. The lower gripper jaw 33 is moved into the release position by the finger 40, which moves the lever gripper jaw 33 downward. Simultaneously a push member 50 on the closing device 41 shifts the gripper carrier arm 28 into the dot dash position shown in FIG. 3. As a result the frame 4 swings around the pin 8. In addition a knife (not shown) of the holding clamp 44 cuts the tying means 47 on the side facing the upper pressure jaw 43.

Figure 9:
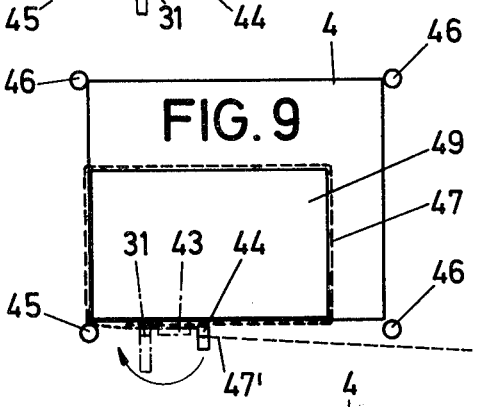

It can be noted from FIG. 9 that the end 47' of the tying means is held fast by the holding clamp 44. The upper pressure jaw 43 then moves out of the plane of the tying means. The package 49 is thus free and can be removed.

Figure 10:
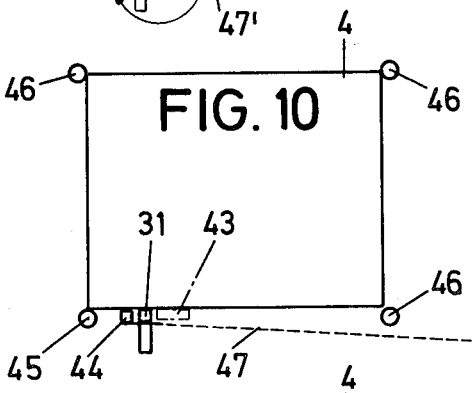

As can be noted from FIG. 10, the holding clamp 44 then moves to the left side of the gripper 31 which is again moved forward with the frame 4 and now clamps the end 47' of the tying means, while the holding clamp 44 opens.

The pull means 17 is then placed in motion, the roller 42 of the gripper carrier arm 28 passing through the control-curve section 25. The gripper 31 now moves on the path indicated by the circles 51, the gripper 31 moving around the holding clamp 44 and the support pin 45. After a complete revolution the gripper 31 again comes into the basic position shown in FIG. 2, the tying means 47 having been placed by the gripper 31 around all of the support pins 45, 46.

The tying means 17 is driven via a chain 52 from a drive motor 53 which at the same time drives the sprocket wheel 55 of the closing device by a chain 54.

All new features mentioned in the specification and shown in the drawing are essential to the invention even if they are not expressly mentioned in the claims.

What is claimed is:

1. A machine for the tying of packages having a gripper which grips and places the tying means around the package along a first predetermined path, the gripper being moved by a pull means, such as a chain, along a second predetermined path, the gripper being stopped after placement of the tying means around the package in a basic position near a closing device which connects the tying means and has a holding clamp for the end of the tying means, the improvement wherein forming a predetermined arcuate section of said second predetermined path with a predetermined center point and locating said basic position of the gripper approximately at said center point.

2. The machine according to claim 1, wherein the package has a plurality of corners and said second predetermined path is formed with at least one corner, corresponding to one corner of the package being tied, the basic position of said gripper being in close proximity to said one corner of the second predetermined path and wherein said machine includes a carrier member supporting said gripper, said carrier member being guided along a third predetermined path including a control curve section between said gripper, when it is in said basic position, and said arcuate section, said control curve section cooperating with said arcuate section to guide movement of said gripper out of the basic position from one side of said holding clamp to an opposite side thereof.

3. The machine according to claim 1, wherein said predetermined arcuate section is formed as a slot, and said pull means is guided in said slot.

4. The machine according to claim 2, wherein said second predetermined path includes a first linear section in advance of said arcuate section and said third predetermined path includes a second linear section in advance of said control curve section, said first and second linear sections being inclined toward each other at an acute angle.

5. A machine for tying packages with a tying means comprising, a frame for supporting said package during tying, a movable carrier member supported on said frame for movement around said package, said carrier member having an attachment portion including a first guide member and a gripper portion for gripping said tying means during movement of said carrier member around said package, said gripper portion having a predetermined basic stop position with respect to said frame after said carrier member has moved around said package with said tying means, pull means in said frame for effecting movement of said carrier member around said package, said pull means being drivingly secured to the attachment portion of said carrier member, said frame including a first path means for said pull means said first path means being engageable with said first guide member to guide movement of said carrier member along said first path means, said first path means including an arcuate section having a center of curvature, said gripper portion being at a predetermined position on said carrier member such that said gripper portion is approximately at said center of curvature when said first guide member is located in the arcuate section, the approximate alignment of the gripper portion with the center of curvature defining the predetermined basic stop position of the gripper portion.

6. The machine according to claim 5, wherein said carrier member further includes a second guide member intermediate said gripper portion and said attachment portion, and said frame includes a second path means engageable with said second guide member, such that movement of said carrier member by said pull means is also controlled by said second guide member and said second path means.

7. The machine according to claim 6, wherein said second path means includes a first control curve section having a common center of curvature with said arcuate section.

8. The machine according to claim 7, wherein said arcuate section and first control section are at respective predetermined selected positions on said carrier member and said frame so as to permit simultaneous engagement of the first guide member in the arcuate section and the second guide member in the first control curve section.

9. The machine according to claim 8, wherein said arcuate section extends a first angular amount measured at said common center of curvature and said first control curve section extends a second angular amount measured at said common center of curvature such that said gripper portion pivots at said common center of curvature during movement of said first and second guide members while in said simultaneous engagement.

10. The machine according to claim 9, further comprising a holding clamp, said gripper portion being on one side of said holding clamp while in the predetermined basic stop position and wherein said second path means includes a second control curve section intersecting said first control curve section, said second control curve section having a center of curvature spaced from the common center of curvature such that movement of said second guide member along said second control curve section from said first control curve section causes said gripper portion to move from said one side of said holding clamp to another side thereof.

11. The machine according to claim 9, wherein said first path means includes a first straight section continuous with said arcuate section and said second path means includes a second straight section intersecting said first control curve section, said first and second straight sections being inclined toward each other at an acute angle.

12. The machine according to claim 9, wherein said first and second path means are formed on channels in said frame.

13. The machine according to claim 12, wherein said first and second guide members comprise rollers engageable in said respective channels.

14. The machine according to claim 5, wherein said pull means is a belt-like member arranged in said first path means to surround said package when said package is supported by said frame.

15. The machine according to claim 14, wherein said belt-like member is a chain.

16. The machine according to claim 5, wherein said first path means includes a plurality of corner portions corresponding to corner portions of said package member, said carrier member being located closer to one of said first path corner portions than any of the other first path corner portions when said gripper portion of said carrier member is at said basic predetermined stop position.

17. The machine according to claim 5, wherein said gripper portion is a clamping jaw having an upper jaw member and a lower jaw member, one of said jaw members being movable with respect to the other jaw member to a closed position to grip said tying means between said jaw members.

* * * * *